US006980888B2

(12) United States Patent
Baker et al.

(10) Patent No.: US 6,980,888 B2
(45) Date of Patent: Dec. 27, 2005

(54) METHOD AND APPARATUS FOR PREDICTING THE RESULT OF A COLORATION

(75) Inventors: Paul Edmund Baker, Reading (GB); David Richard Hayman, Staines (GB)

(73) Assignee: The Proctor & Gamble Company, Cincinnati, OH (US)

( * ) Notice: Subject to any disclaimer, the term of this patent is extended or adjusted under 35 U.S.C. 154(b) by 112 days.

(21) Appl. No.: 10/603,958

(22) Filed: Jun. 25, 2003

(65) Prior Publication Data

US 2004/0010333 A1 Jan. 15, 2004

(30) Foreign Application Priority Data

Jun. 26, 2002 (EP) ..... 02254475

(51) Int. Cl.[7] ..... G06F 17/00; G09B 19/10

(52) U.S. Cl. ..... 700/236; 700/90; 700/240; 345/641; 434/94

(58) Field of Search ..... 700/104, 214, 700/215, 225, 234, 236, 90, 240; 434/94; 345/641

(56) References Cited

U.S. PATENT DOCUMENTS 4,160,271 A * 7/1979 Grayson et al. ..... 700/90
4,434,467 A 2/1984 Scott
5,060,171 A * 10/1991 Steir et al. ..... 345/630
5,163,010 A 11/1992 Klein
5,797,750 A 8/1998 Gouriou et al.
5,855,626 A 1/1999 Wiegner
5,862,947 A 1/1999 Wiegner
6,141,431 A * 10/2000 Munetsugu et al. ..... 382/100
6,583,792 B1 * 6/2003 Agnew ..... 345/660
6,665,686 B1 * 12/2003 Kagami et al. ..... 707/104.1
6,707,929 B2 * 3/2004 Marapane et al. ..... 382/100
6,719,565 B1 * 4/2004 Saita et al. ..... 434/94
2003/0065450 A1 4/2003 Leprince

FOREIGN PATENT DOCUMENTS

EP 0290327 A1 11/1988
EP 1138374 A1 10/2001
EP 1147722 A 10/2001
EP 1147722 A1 10/2001
WO WO-00/15073 A1 3/2000
WO WO-01/87245 A2 11/2001
WO WO-01/91602 A2 12/2001

* cited by examiner

*Primary Examiner*—Albert W. Paladini
*Assistant Examiner*—Sheela S. Rao
(74) *Attorney, Agent, or Firm*—Michael J. Sambrook; Brian M. Bolam; Tara M. Rosnell

(57) ABSTRACT

A method and apparatus for predicting the result of the coloration of a substrate by a coloring product. The method and apparatus involve the use of micro-processing system and are especially suitable for quickly and easily determining the result of hair coloration by a commercial hair dye product. Preferably a bar-code scanning device is used to input information relating to the product into the micro-processing system.

26 Claims, 10 Drawing Sheets

METHOD AND APPARATUS FOR PREDICTING THE RESULT OF A COLORATION

FIELD

The invention relates to a method and apparatus for predicting the result of coloration of a substrate by a coloring product. The method and apparatus are especially suitable for quickly and easily determining the result of a cosmetic coloration of a substrate such as hair, skin or nail by a commercial product.

BACKGROUND

Bleaching and coloring (or dyeing) of hair has become increasingly popular over the past years. Younger people may want to change the natural color of their hair to a more fashionable one, while older people may also use dyeing products to conceal gray hair. As a result there is an extremely large choice of available products for consumers to choose from. Often, the individual consumers find it difficult to determine which hair coloring product to choose to achieve their desired color.

Hair coloring products may be sold in packages displaying a coloring chart with three or more starting colors and three or more corresponding resulting colors. However, consumers have difficulties identifying which of the starting colors best matches their starting hair color and more choice of starting colors is desirable for a more accurate result. Furthermore consumers often do not trust the accuracy of the printed color chart on the carton.

Complicated systems have been designed in the past wherein the consumer inputs information about the starting color of his/her hair and the desired color, the system then matching this information with a commercial product that will provide the desired result. These systems can be implemented on a computer or via mechanical means such as cooperating wheels.

For example EP290327 discloses an apparatus for selecting a coloring product capable of achieving a desired hair color. The apparatus comprises a micro-processing unit, a memory bank relating to available coloring products, a keyboard for inputting information about the starting and the desired color into the micro-processing unit, and a printer connected to the micro-processing unit. The micro-processing unit is programmed to predict from the inputted information a suitable coloring product, whose reference is then printed on paper.

EP1147722 discloses a hair color advice system comprising a digital camera for taking a picture of a subject, a computer processing means and a computer screen. The computer processing means is programmed to analyze the picture taken, distinguish the hair area in the picture and electronically change the color of the hair area to a new color. The modified picture is displayed on the computer screen and, if the subject is satisfied by the displayed color, the processing means is used to predict a coloring product suitable for providing the desired color to the subject's hair.

U.S. Pat. No. 4,434,467 discloses a device for determining the hair coloring products to be used to change a subject's initial hair color to a desired hair color comprising an electronic data processing system.

WO01/87245 discloses a system for recommending a hair coloring product, said system comprising a colorimeter or spectrophotometer for analyzing the initial hair color of a subject and a computer system implemented with a color prediction model. The system is capable of identifying at least one achievable end hair color based upon said initial hair color and optionally other parameters such as hair damage, and is also capable of recommending a suitable coloring product for achieving any of the achievable hair color upon request from the subject.

EP1,240,845 discloses an apparatus for providing personalized advice regarding hair coloring.

It has now been found that consumers were often confused by the large choice of coloring products available in store and that selecting and trying a new coloring product is a stressful and sometimes disappointing experience. Consumers will often pick a coloring product on a shelf, spend a few minutes reading the information printed on the package to eventually put it back as the information displayed will leave them in doubt as to the result the product will give on their hair. Furthermore, consumers are often disappointed by the result of hair coloring and need to try several different products (typically 3–4) before finding a product providing their desired final hair color. There is therefore a need for a method of quickly and simply predicting the result of a coloration of a substrate such as hair by a specific coloring product.

SUMMARY

The present invention is directed to a method and apparatus for quickly and simply predicting the result of the coloration of a substrate (e.g. hair) by a specific coloring product (e.g. hair dye). The method comprises the steps of inputting information relating to the coloring product in a micro-processing system, inputting information relating to the initial color of the substrate in the micro-processing system, predicting from the input information a likely result of the coloration of the substrate, and displaying the likely result.

The method may comprise the further steps of inputting information relating to a desired color different from the result displayed in the predicting system, predicting at least one coloring product capable of providing the desired color to the substrate, and displaying information about the at least one coloring product capable of providing the desired color.

The methods according to the present invention may be implemented on an apparatus comprising a micro-processing system, means for inputting information relating to the coloring product in the micro-processing system, means for inputting information relating to the initial color of the substrate in the micro-processing system, wherein the micro-processing system is capable of predicting from the input information a likely result of the coloration of the substrate by the coloring product, and means for displaying the likely result of the coloration as predicted by the micro-processing system.

The method and apparatus according to the present invention may be used at the point of purchase of coloring products, for example department stores, drug stores, mass markets, groceries or virtual supermarkets accessible on the Internet. The user of the method and device may be the consumer of the product, a beauty advisor (e.g. in a salon) or another person.

These and other features, aspects, and advantages of the present invention will become evident to those skilled in the art from a reading of the present disclosure.

BRIEF DESCRIPTION OF THE FIGURES

While the specification concludes with claims which particularly point out and distinctly claim the invention, it is believed the present invention will be better understood from the following description of preferred embodiments taken in conjunction with the accompanying drawings, in which like reference numerals identify identical elements and in which:

DETAILED DESCRIPTION OF THE PREFERRED EMBODIMENTS

All cited references are incorporated herein by reference in their entireties. Citation of any reference is not an admission regarding any determination as to its availability as prior art to the claimed invention.

Herein, "comprising" means that other steps and elements can be added. This term encompasses the terms "consisting of" and "consisting essentially of". The methods/processes and apparatuses of the present invention can comprise, consist of, and consist essentially of the essential elements and limitations of the invention described herein, as well as any of the additional or optional steps, elements or limitations described herein.

The methods and apparatus according to the present invention may be used for quickly and simply predicting the result of the coloration of any type of substrates with any type of coloring products, and is especially suited for being used for predicting the result of the coloration of human hair with hair dye products. Several brands coexist on the hair dye markets, and each brand may encompass dozens of different products. The methods and apparatus according to the present invention are especially useful in department stores where a large choice of different hair dye products is available. However, the methods and apparatus may be used anywhere without departing from the scope and spirit of the present invention, for example in a salon. Examples of other coloring products that may be used include nail varnishes, lipsticks, foundations, mascaras and blushers.

Figure 1:
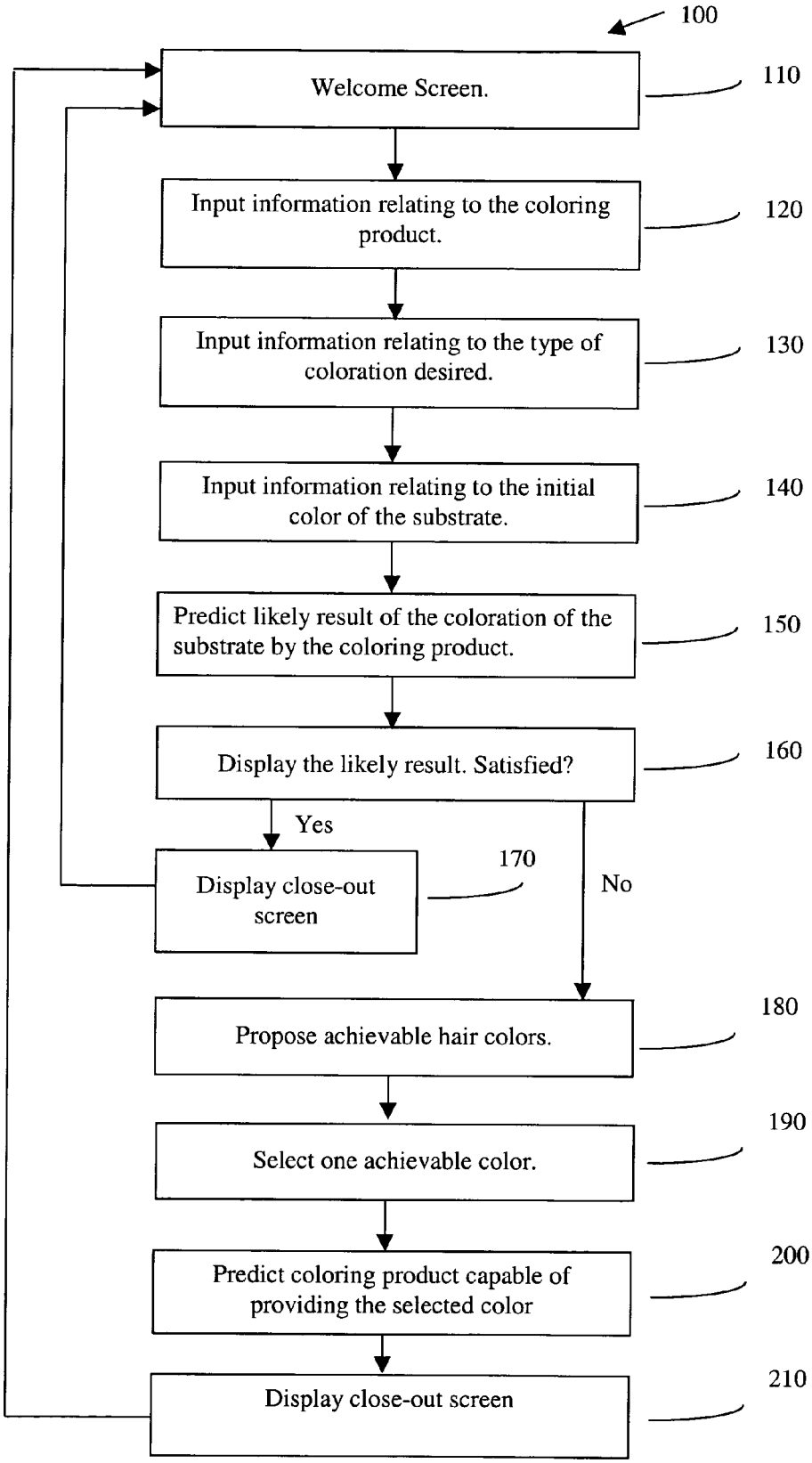
FIG. 1 is a block diagram 100 of an embodiment of a method according to the present invention.

An embodiment of the method of the present invention is illustrated in block diagram 100 of FIG. 1. This method may be embodied in the apparatus 2 described in FIGS. 8–12, which comprises a base 4, a computer screen 6 and mirror 8 both mounted on a adjustable support 10 which can pivot relatively to the base 4, a tray 12 fixed to the base 4 and equipped with a bar code scanning device (not represented). The apparatus also comprises a micro-processing system (not represented) connected to the bar code scanning-device and computer screen 6. The micro-processing system may be installed inside the base 4. The computer screen 6 may be a conventional or interactive ("touch-screen") screen, such as a cathode ray tube (CRT) computer screen, a plasma screen, a liquid crystals screen or any other type of screen that may be connected to the micro-processing system. The computer screen should be calibrated to accurately display colors, for example using the International Color Consortium (ICC) standard for screen calibration.

Preferably the computer screen is of the interactive ("touch-screen") type, wherein information may be input into the micro-processing system by pressing sensitive areas of the screen. In a preferred embodiment as represented in FIGS. 8–12, a thin film transistor (TFT) interactive screen is used. The TFT interactive screen 6 is intended to give and receive information for the purpose of executing the method. Interactive screens have pressure sensitive areas on their surface that sends an electronic signal when touched. Other means for inputting information into the micro-processing system may be used. For example any electro-mechanical devices capable of transforming a movement or pressure into an electronic signal are suitable, such as light pens or stylus used with an adapted screen. If a conventional, non-interactive screen is used, another example of means for inputting information into the micro-processing system is one or more push buttons, for example situated on the front side of the base 4.

Figure 2:
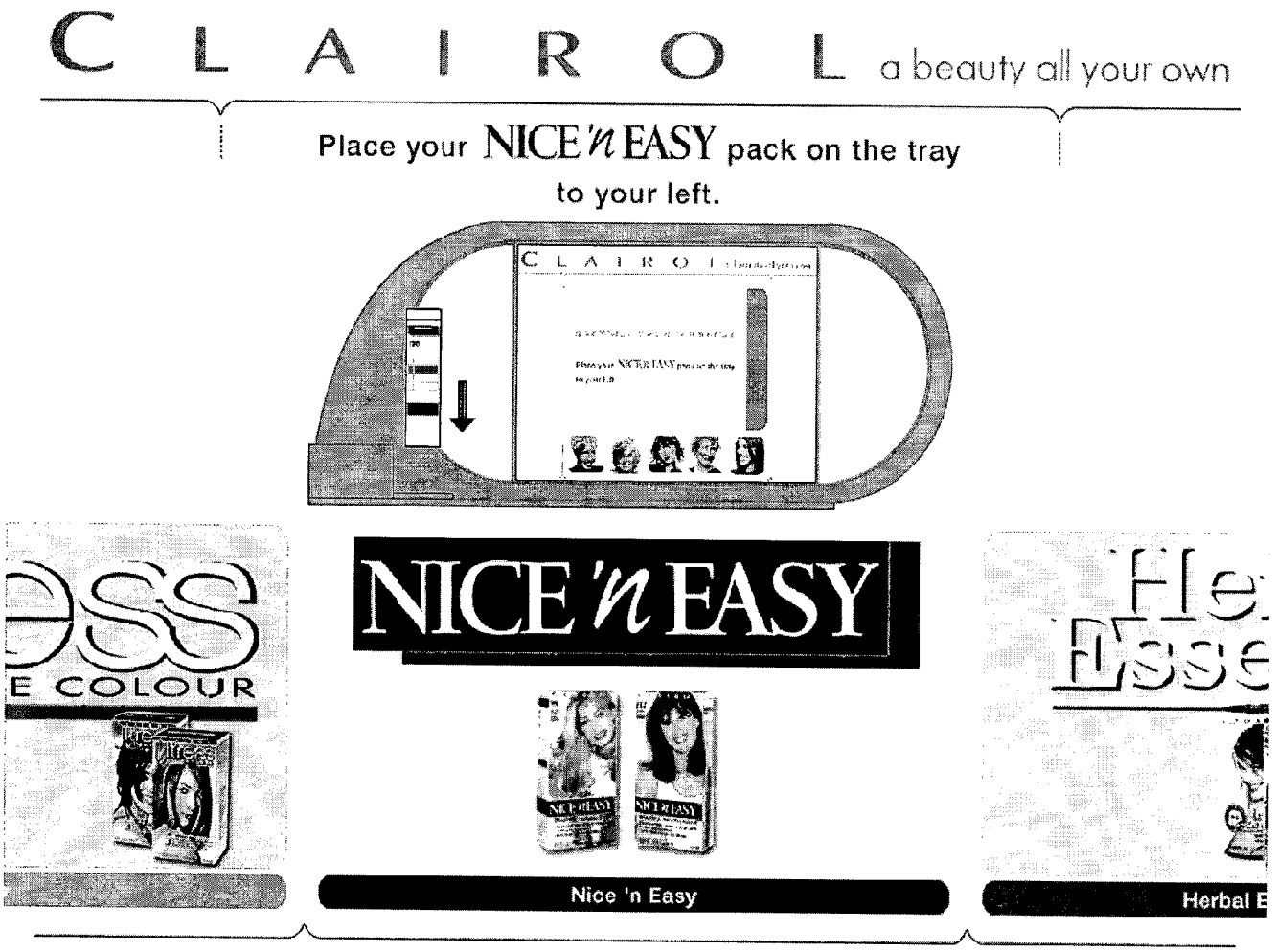
FIG. 2 is a screen shot of a welcoming screen which may be used in block 110 within FIG. 1.

The method 100 referred to in FIG. 1 comprises a series of blocks (or method steps) 110 to 210. These blocks will now be described in detail. Referring to FIG. 1, the method 100 begins with a block 110 containing a welcome screen. The welcome screen may be designed to attract the consumers, for example by displaying animated pictures or messages, or by being reactive to consumer's motion. The welcome screen may contain a reference to a specific coloring house, for example CLAIROL (RTM) and coloring families belonging to that coloring house (for example ULTRESS(RTM), NICE'N EASY(TM) as is illustrated in FIG. 2. The welcome screen also preferably displays instructions explaining how the user may initiate the method and proceed to the next step. For example in a preferred embodiment, the user is prompted by the welcome screen to input information relating to the coloring product into the micro-processing system, and thereby proceeds to block 120, by placing a packaged coloring product on the transparent or semi-transparent tray 12, which is equipped with a bar-code scanning device.

In a preferred embodiment, the bar-code scanning device automatically scans the bar-code displayed on the bottom of the package and electronically transmits this information to the micro-processing system. Bar-code scanning devices are known in the art and are available, for example, from Retec Europe Ltd, Letchworth, England. The micro-processing system comprises a digital database referencing all coloring products that may be used with the apparatus and matches the information transmitted by the scanner with the coloring product scanned. If the database is unable to find a reference with the products scanned (for example because the product belongs to a non-referenced brand or has not been referenced yet), an error message may be displayed on the screen 6 and the method is reinitialized to the welcome screen of block 110. If the micro-processing system matches the information transmitted by the scanner with a coloring product referenced in the database, then the user is brought to block 130 of the method 100. Although a bar-code scanning device is preferred for its simplicity and rapidity of use, other means for inputting information about the coloring product could be used (for example a list of products could be displayed on the screen 6 and selected by turning and pressing buttons, or simply by pressing the area of a TFT interactive screen displaying the name of the coloring product). The bar-code and bar-code scanning device could also be replaced, for example, by a Radio Frequency Interference (RFI) chip (also called "intelligent" or "smart" label) and a RFI scanning device.

Figure 3:
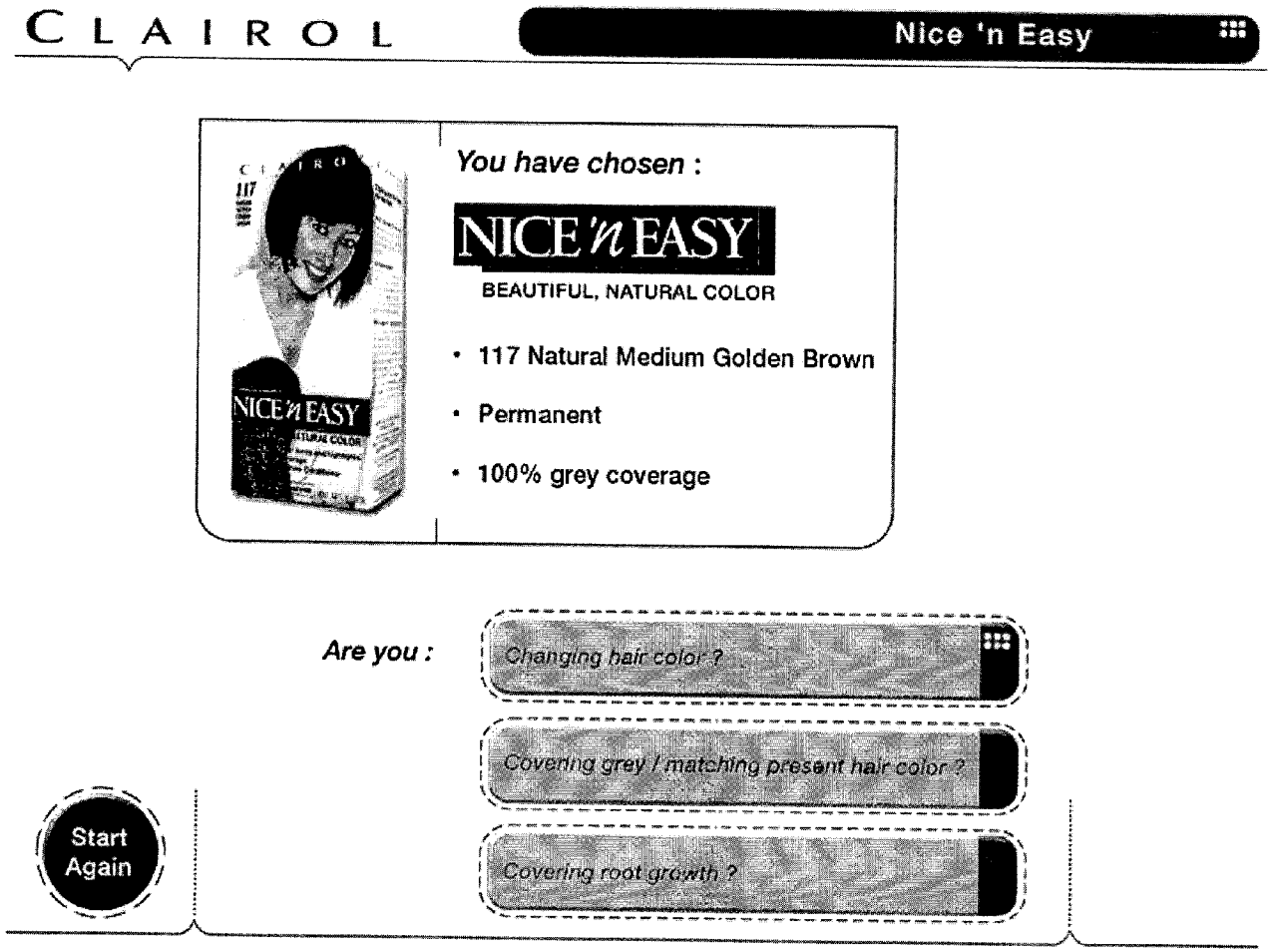
FIG. 3 is a screen shot of an input screen which may be used in block 130 within FIG. 1.

Once the information relating to the product (which can be any coloring products, such as a hair dye or foundation) has been input, the computer screen may display a message prompting the user to input information relating to the type of coloration desired (for a hair product this may be gray coverage, root coverage or highlight, as illustrated in FIG. 3), and/or information relating to the initial condition of the substrate, apart from its initial color (for e.g., if the substrate is hair, it may be previously colored, virgin (never colored) and/or damaged). This information may be later used by the micro-processing system to more accurately predict the resulting color of the coloration and/or predict a suitable product for the type of coloration desired. In a preferred embodiment, the user will touch the area of the screen displaying the type of coloration desired (for example covering gray/matching present color) and this information will be transmitted to the micro-processing system and stored in its memory.

The information relating to initial color of the substrate is input into to the micro-processing system in the next step of the method (represented by block 140 in FIG. 1). In a preferred embodiment, a message displayed on the screen will prompt the user to select a color from a predetermined set of colors and matching as closely as possible the initial color of the substrate. A pre-selection screen may be provided before this step, for example wherein a limited choice of category of colors (for hair color this may be Blonde, Brown/black or Red/Auburn) is proposed. With this pre-selection step, the micro-processing system may determine a reduced number of possible matching colors to display next, thereby helping the user to select the matching color more quickly.

Figure 4:
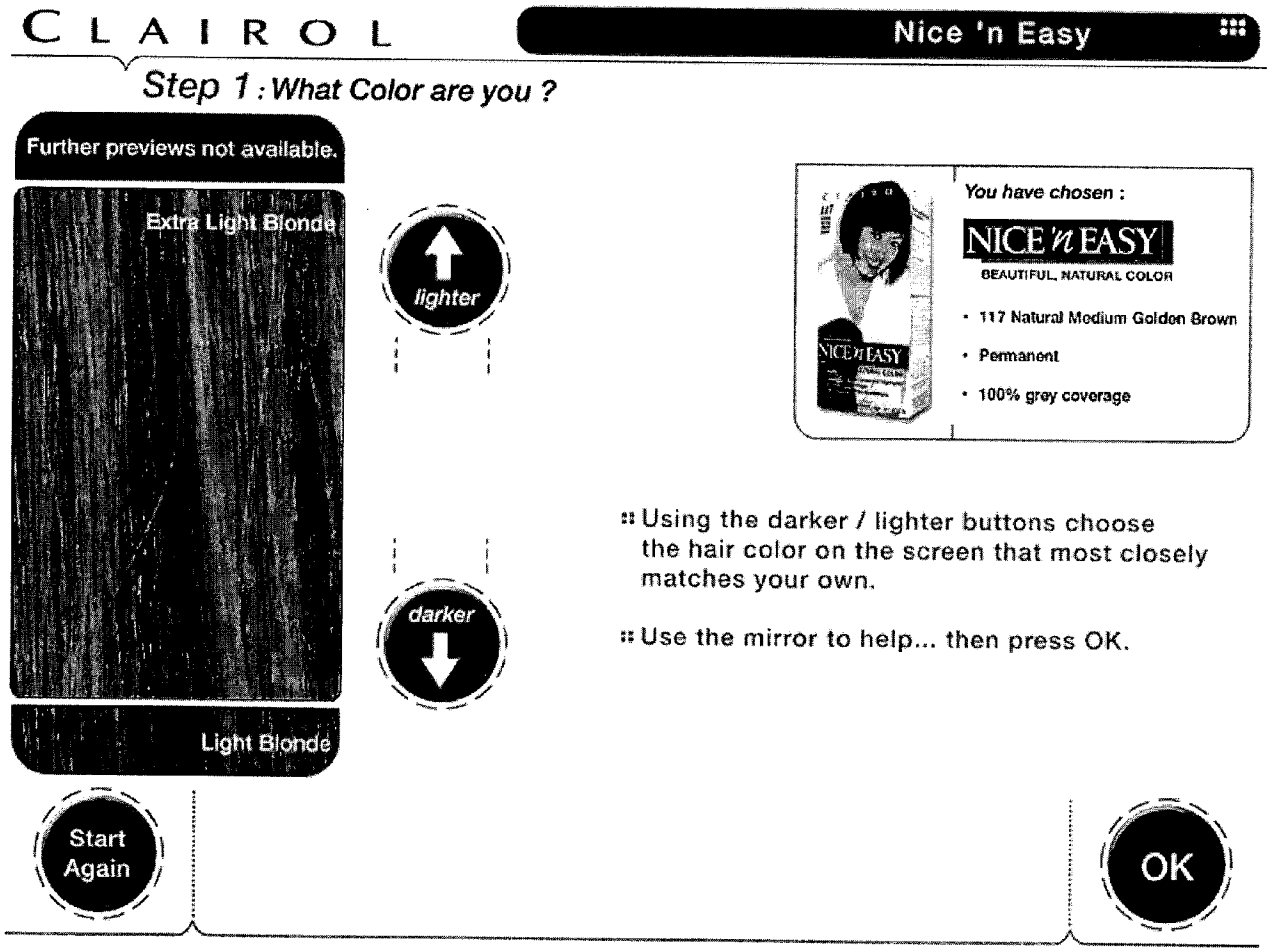
FIG. 4 is a screen shot of an input screen which may be used in block 140 within FIG. 1.

As illustrated on FIG. 4, the matching color may be selected by pressing sensitive areas of the interactive screen 6. In a preferred embodiment, all predetermined colors are not simultaneously displayed as this may be detrimental to the readability of the screen. The predetermined set of colors is preferably ordered within a list, according to a visually recognizable parameter, for example from lighter to darker. The tonal value (for hair this may be natural, blue ash, green ash, gold, copper, red and violet) or the combination of tonal value and lightness of the colors may also be used as a sorting parameter. In a preferred embodiment, a color may be represented by an image or picture of a substrate (e.g. a swatch of hair) having the corresponding color (or shade). One relatively large area of the screen may be reserved for the display of one color at a time (e.g. "Extra light blond" on FIG. 4), and two smaller areas set on opposite sides of this large area are used to display colors immediately above and below the hierarchical level of the list (if available). With this system the user can quickly navigate in the list of predetermined colors and select the color matching best its initial color. As illustrated on FIG. 4, the navigation in the list of predetermined colors may be effected by pressing pressure sensitive areas of the interactive screen representing arrows and displaying short messages such as "lighter" or "darker". In order to help the user to select the best matching possible shade, a mirror 8 may be situated near, e.g. on the side of, the area of the screen displaying the selectable color (see FIG. 8). If the substrate is hair, this mirror may be used to reflect a swatch of the hair to be dyed, allowing the user to quickly compare this swatch with the color displayed on the screen and thereby quickly determining the predetermined color best matching the initial color of the substrate. In the case of user having gray hair, if the system is not adapted to allow the selection of a gray hair shade, an advice may be displayed recommending the user to select the hair color closest from the main/original color.

When the user is satisfied that the color displayed matches as well as possible the initial color, a validation button (which may be represented on the interactive screen) may be pressed. Other means for inputting the information relating to the initial color of the substrate may be used, for example automatic capture and display of the users starting hair color using a digital or video camera, contact or non-contact spectrophotometer. Suitable colorimeter or spectrophotometer systems for taking hair color readings and inputting them in a computer system have been disclosed in WO01/87245. Selecting a matching color from a predetermined list as described above is preferred as this method is relatively simple and does not necessitate expensive equipment such as a spectrophotometer.

In the next method step, designated by block 150 in FIG. 1, a suitably programmed micro-processing system predicts the likely result of the coloration from the information that has been input (information relating to the initial color of the substrate, information relating to the coloring product and optionally information relating to the type of coloration desired and/or to the initial condition (other than its color) of the substrate to be colored).

Figure 5:
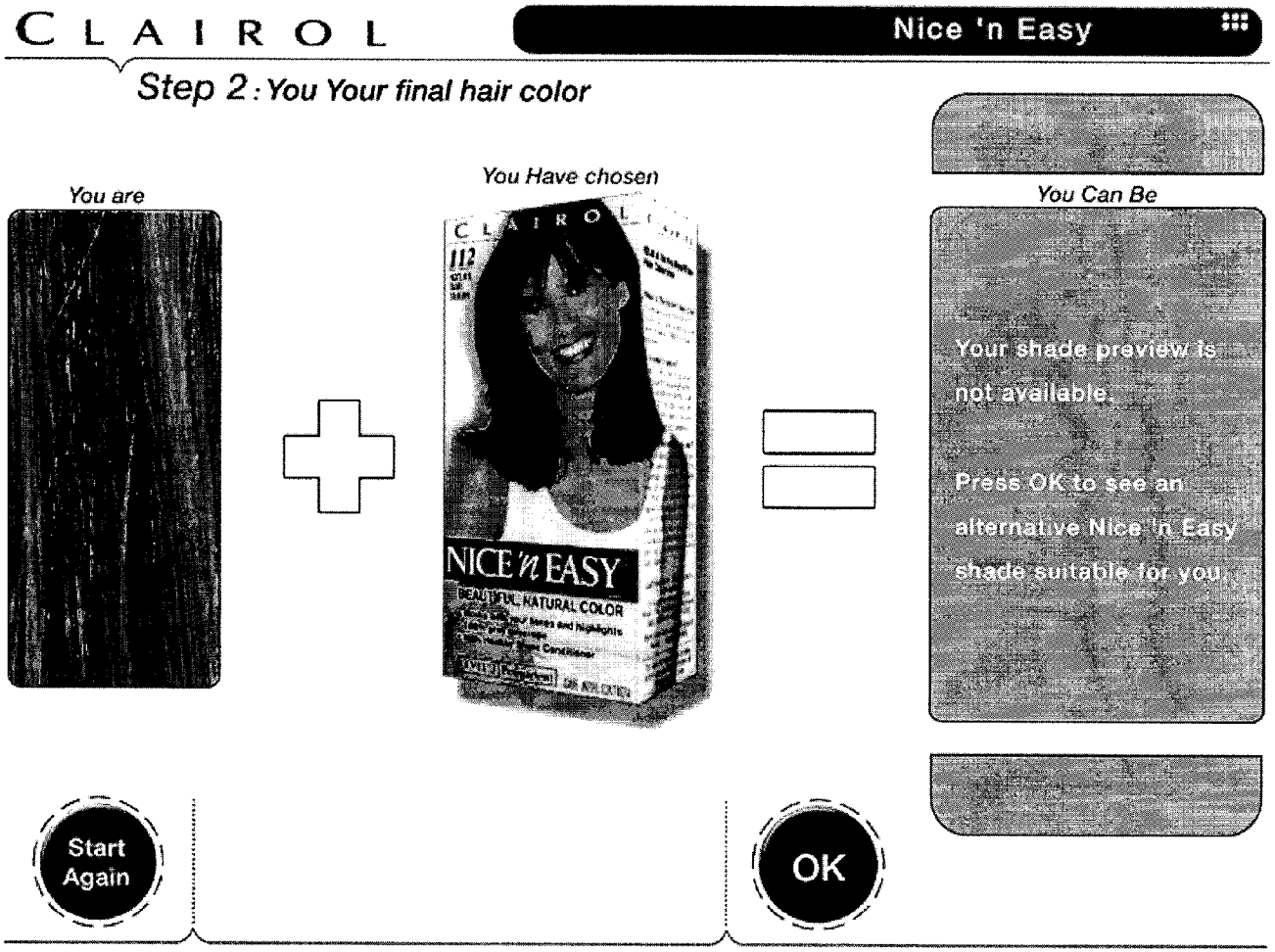
FIG. 5 is a screen shot of a display screen which may be used in block 150.

To do so, the micro-processing system may comprise a database in the form of a matrix, one entry of the matrix being the information relating to the initial color of the substrate and the other entry being the information relating to the coloring composition. The values inside the matrix are filled with data obtained from previous experimental testing, for example data obtained by coloring hair of consumers recruited to participate in a colorant program at a salon. The initial starting color and the resulting color obtained after the coloration were recorded and each result input as one data of the matrix. If some values are missing to totally fill the matrix, these values may be generated using one or more models extrapolating the data obtained for similar compositions with different hair dye products, or extrapolating data obtained for different compositions with similar hair dye products. If the user inputs information about a coloring product and an initial color for which there is no data available, an error message may be displayed (as illustrated on FIG. 5) and another coloring product that has been tested with the initial color proposed to the user instead. Preferably however all products should have been tested with all predetermined initial hair colors that the user may select on the screen. As determined during the experimental testing, some products may be totally incompatible with some initial substrate colors, and this information may also be used in the later steps of the method (see description of block 180 below). Color prediction models may also be used instead or in combination with a matrix. Such color prediction models are described in WO01/87245.

A personal computer (PC) or any other type of computers or micro-processing machines can be easily programmed with these matrixes and/or models and with a method for retrieving the data entered in the matrixes. Additional information that may have been input in block 130 may also be used in this stage in order to more precisely predict the likely result of the coloration. For example, if the coloration is used to conceal gray hair instead of just changing the hair color of virgin, non-gray hair, then another pre-determined matrix may be used by the micro-processing system for the prediction, or the data of the matrix used for "changing hair color" could be shifted by a pre-set value believed to be representative of the difference between the result obtained when the coloration is used to conceal gray hair and the result obtained with the same product for changing hair color.

One suitable type of micro-processing system comprises a main or central processing unit (CPU) which is connected via suitable adapters to a main memory (e.g. Random Access Memory (RAM)), a mass data storage system such as an hard drive for saving the data programmed in the system, a computer readable medium reader such as CD-ROM and/or a floppy disk drive for loading the method steps in the form of a computer program into the micro-processing system, the interactive screen 6 and optionally one or more other display means such as a printer. The micro-processing system may also comprise a suitably connected network card that allows the system to be remotely programmed, for example for adding new products or colors to the database. The network card may also be used to communicate with other computers, for example with the computer managing or monitoring the stock of coloring products. This may be used to ensure that the most popular products selected by the user are adequately supplied, or enable to hold 'real time' in-store sales of slow selling product/colors. The micro-processing system may then be updated to display or advertise on screen "real time" promotions of those slower selling products. The micro-processing system may also be programmed to guide the consumer (e.g. by displaying a map) to a certain area of the shop where the product recommended in block 210 of the method 100 may be found (this block is discussed below).

Figure 6:
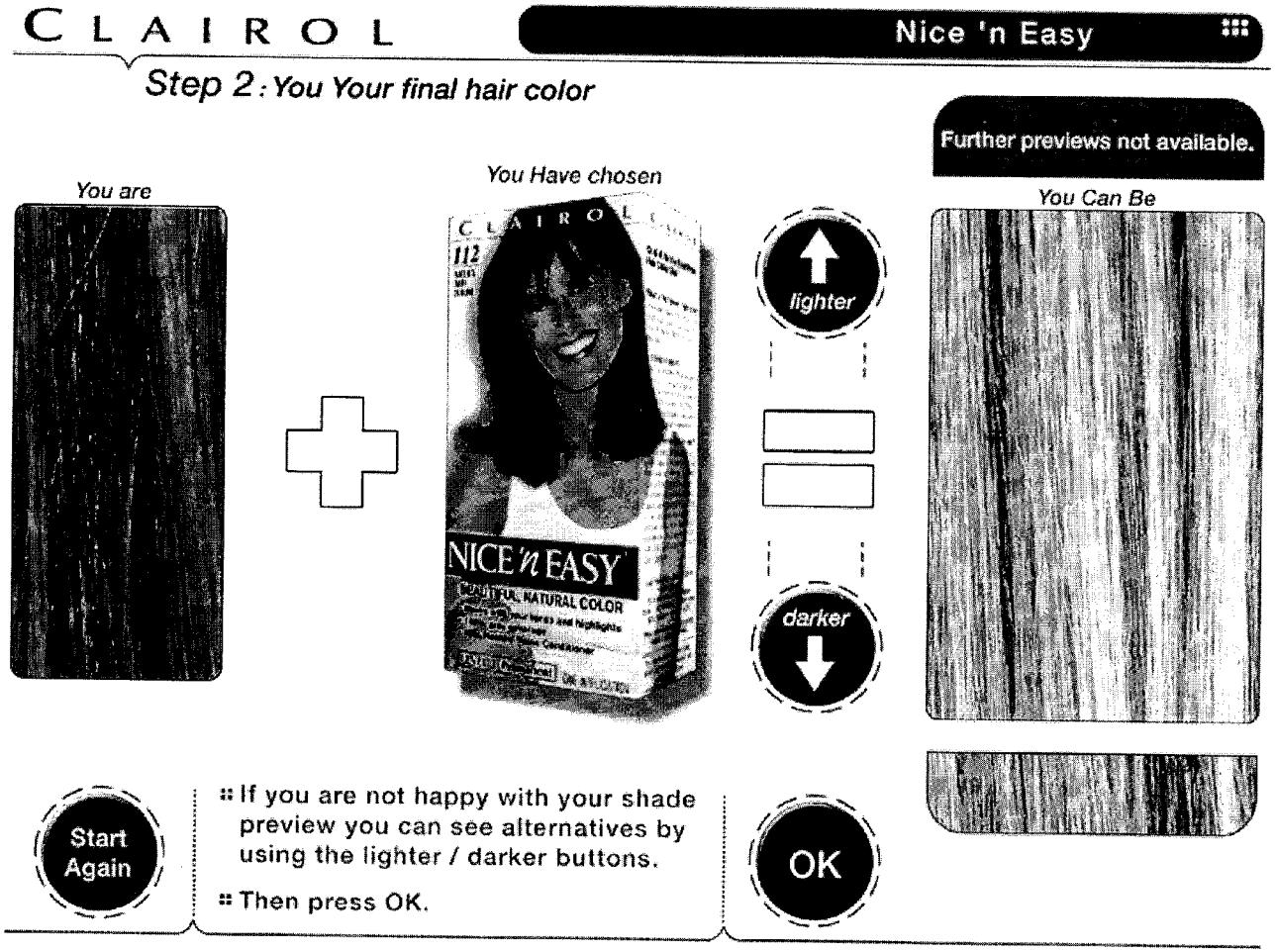
FIG. 6 is a screen shot of a result display and input screen which may be used in block 160 and blocks 180–200 within FIG. 1.

The likely result of the coloration as determined by the program is then displayed in the next step of the method, referred to as block 160 in FIG. 1. FIG. 6 illustrates a screen shot of a computer screen display that may be used in this block. In this embodiment, the likely result is displayed on a relatively large area of the screen 6 as a picture of a swatch of hair of the predicted resulting color. In this embodiment the likely result is selected from a pre-determined set of colors, which is ordered in a hierarchical list according to a visually recognizable parameter, for example from lighter to darker and/or tonal value. Two smaller areas set on opposite sides of the displayed swatch of hair are used to display colors immediately above and below the hierarchical level of the list (if the color displayed represents one extreme of the list, e.g. extra-light blond, then only one color may be displayed), in order to ease the navigation into the list. Optionally a printer may be connected to the micro-processing system and upon request a color print-out of the predicted color may be provided to the user. The printer may also be used for printing coupon for discounted purchase and reward voucher.

Figure 7:
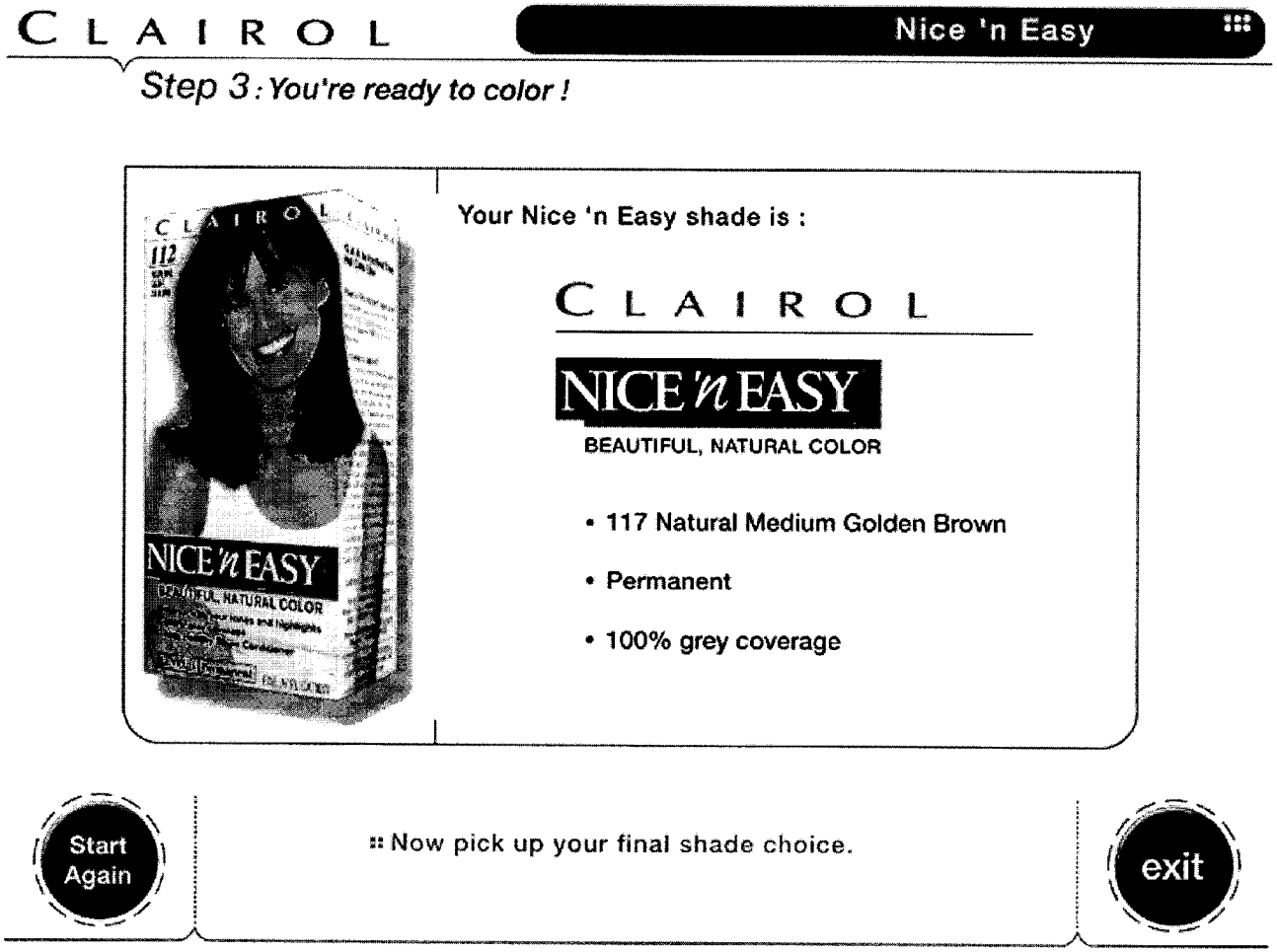
FIG. 7 is a screen shot of a close-out screen which may be used in block 170 and block 210 within FIG.1.
Figure 8:
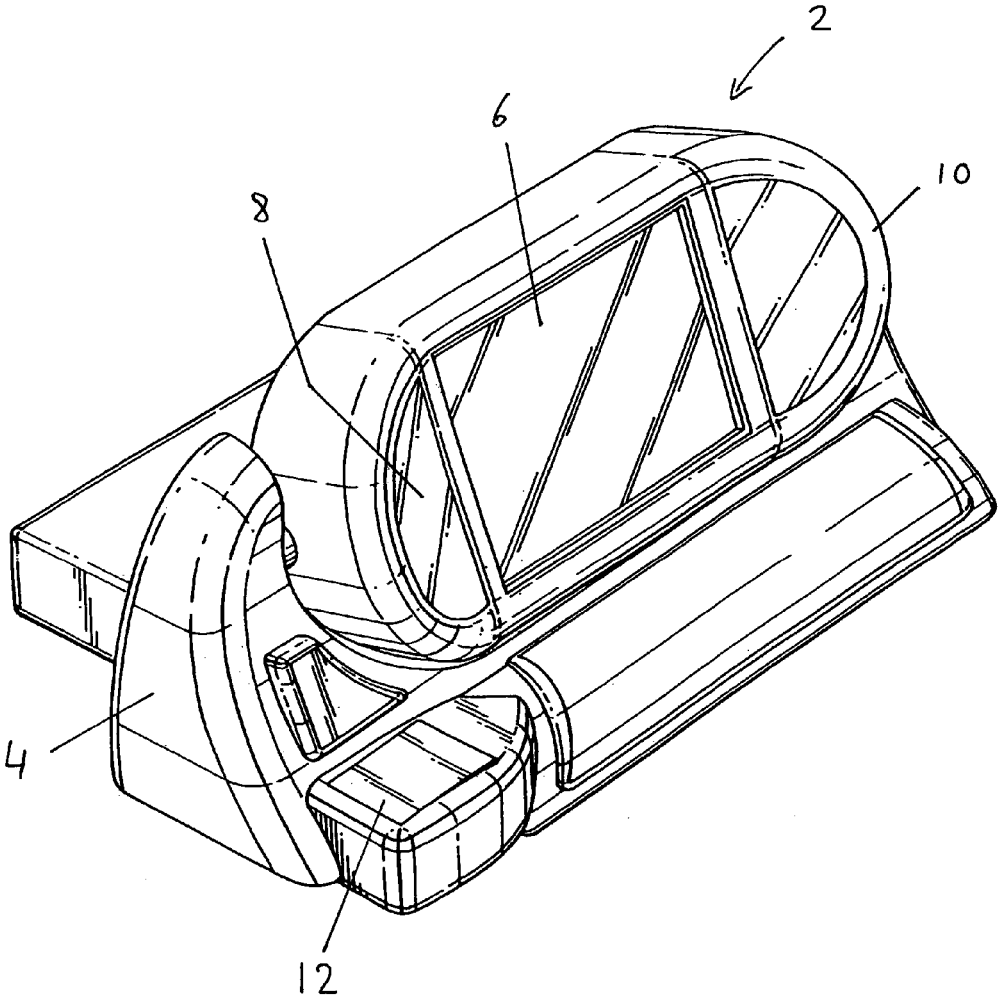
FIG. 8 is a perspective view of an embodiment of an apparatus according the present invention.
Figure 9:
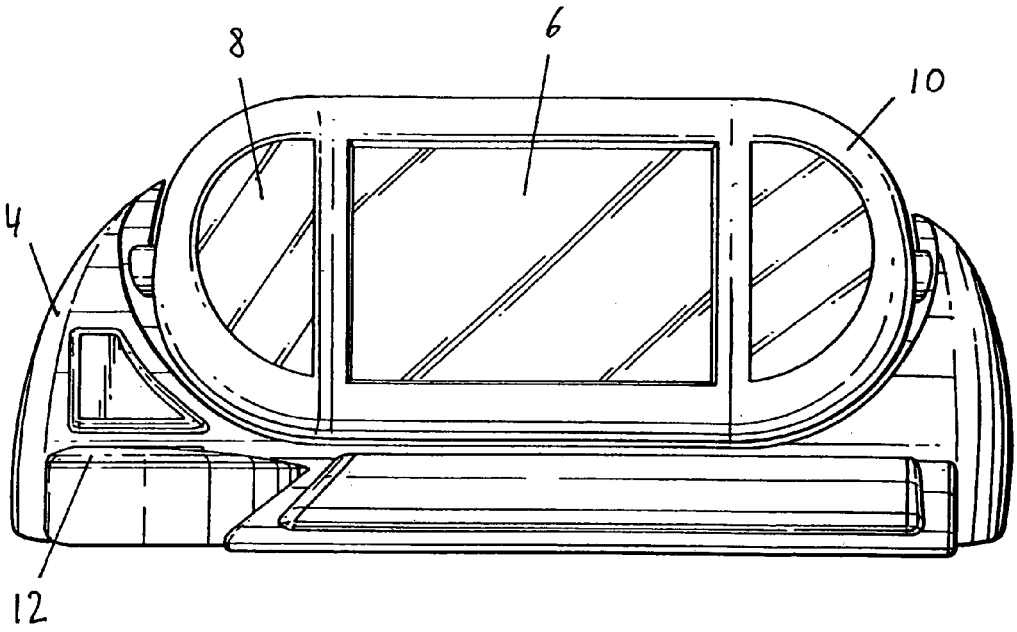
FIG. 9 is a frontal view of the embodiment of FIG. 8.
Figure 10:
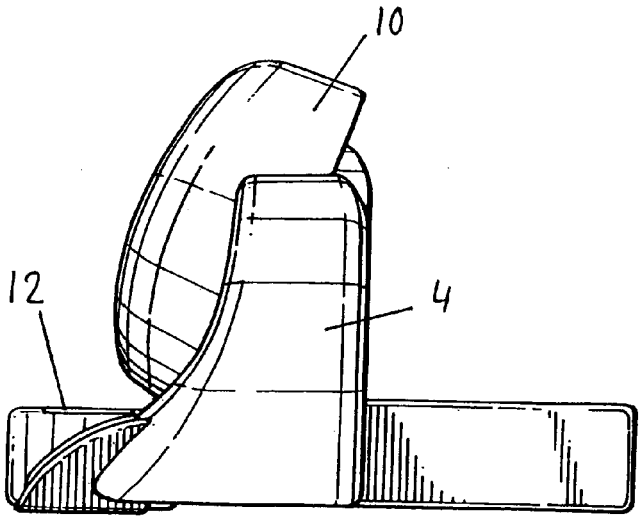
FIG. 10 is a side view from the right of the embodiment of FIG. 8.
Figure 11:
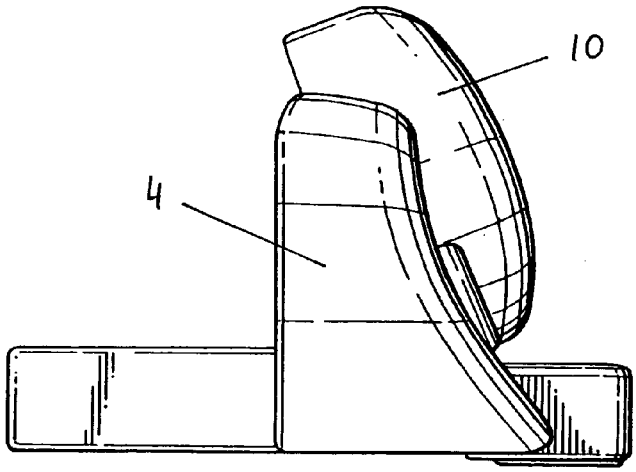
FIG. 11 is a side view from the left of the embodiment of FIG. 8.
Figure 12:
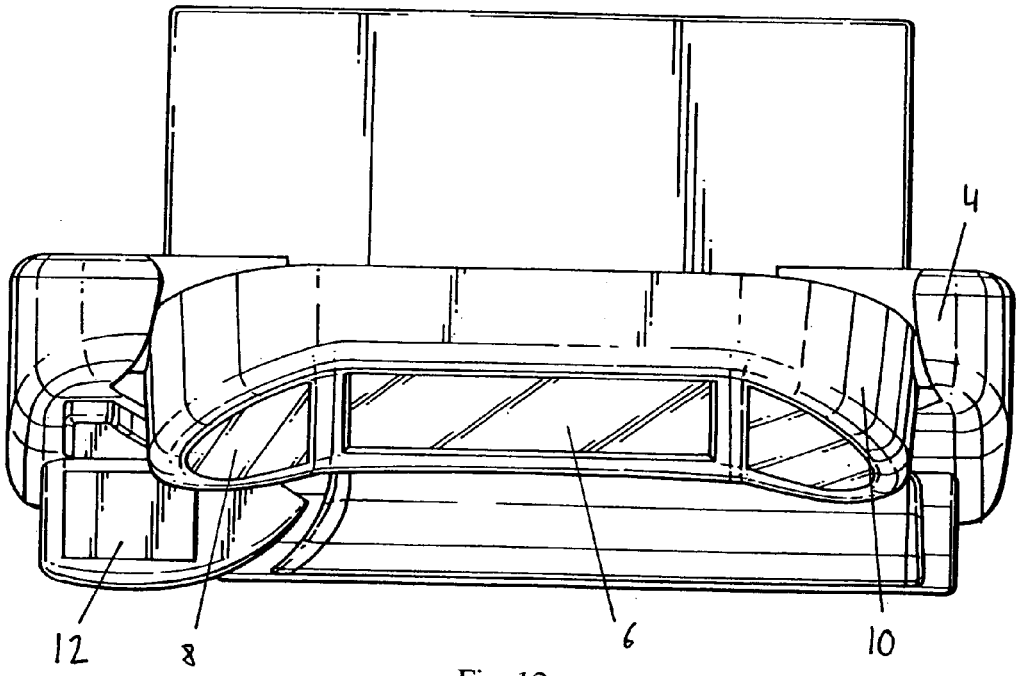
FIG. 12 is a top view of the embodiment of FIG. 8.

If the user is satisfied by the resulting color displayed, an affirmative button (for example displaying the word "OK") on the interactive screen is provided to bring the user to a "close-out" or "recommendation" screen (block 170, which is illustrated on FIG. 7). A "start button" is provided to reinitialize the method to block 110 for the next user. Alternatively, the program will automatically reinitialize the method to block 110 for the next user after a set period of inactivity.

On the other hand, if the user is not totally satisfied or is curious about other achievable colors, the user may modify the color displayed in the result area by pressing pressure sensitive areas on the surface of the interactive screen having the form of buttons displaying arrows and short messages such as "lighter" or "darker" (as illustrated on FIG. 6). By pressing these buttons the user proceeds to block 180 as referred to in FIG. 1. In this block the user has access to all the achievable colors as determined by the micro-processing system from the information relating to the initial hair color. The user can "scroll" or "navigate" in this list of achievable color until a satisfying or desired color is displayed, the smaller area displayed above and below the displayed swatch of hair facilitating this navigation by giving an overview of the next (lighter or darker) color in the list.

The user then indicates to the micro-processing system that the displayed color is the desired color (block 190 in FIG. 1) by pressing the area of the interactive screen presenting an affirmative message (for example the button displaying the short message "OK", as illustrated on the screen shot of FIG. 6). With the information relating to the desired color and the information relating to the initial hair color, the micro-processing system extracts (block 200 in FIG. 1) from the products matrixes discussed earlier one or more products capable of providing the desired color selected in block 190. In the following step (block 210 in FIG. 1), information relating to at least one of the products capable of achieving the desired color as determined by the micro-processing system is displayed on the screen 6. The information displayed must be sufficiently complete for the user to identify what products, or what range of products if several products are suitable, may be used. As illustrated on FIG. 7 this information may be a picture of the packaged product. Upon user's input, e.g. pressing a button represented on the interactive screen, the method is reinitialized to block 110 (containing the welcome screen) or to block 180 if the user wishes to try another achievable color.

It is understood that the examples and embodiments described herein are for illustrative purposes only and that various modifications or changes in light thereof will be suggested to one skilled in the art without departing from the scope of the present invention.

For example, the person skilled in the art would readily understand that method blocks 110, 120, 130 as referred to in FIG. 1 may be performed in any order, for example the user could first input the information relating to its initial hair color and then only the information relating to the coloring product. Means for reinitializing the method to the first step (e.g. block 110) of the method at any stage may also be provided. For example the method may be reinitialized to block 110 by re-scanning a new pack or pressing a "start again" button on the screen at any time. Means for commanding the micro-processing system to go back to the previously completed step of the method may also be provided, for example by pressing an area of the interactive screen displaying an easily understandable message such as "back". This would allow the user to quickly test the result of these different inputs at each input step of the method.

A loyalty card, smart card (RFI) chip, Compact Disc or the like may also be used as a marketing tool with the apparatus for carrying out the method. This would allow the consumers to earn points, discounts or coupons (money off next purchase) to help build customer loyalty to the brand(s). The consumer may also be provided with:

a) beauty advice and/or color tips;
b) video or animated instructions on how to use the Product/Package;
c) their personal coloring history—products/colors used and when;
d) other related products recommended (e.g. conditioners);
e) in the case of a computer readable medium such a Compact Disc, a link to the brand website.

What is claimed is:

1. A method for predicting the result of the coloration of a substrate by a coloring product, said method comprising the steps of:

a. inputting information relating to the coloring product in a micro-processing system,
b. inputting information relating to the initial color of the substrate in the micro-processing system, wherein the information relating to the initial color of the substrate is a matching color selected from a predetermined set of colors, and wherein step a and b may be performed in any order,
c. predicting from the input information a likely result of the coloration of the substrate, and
d. displaying the likely result.

2. A method according to claim 1 wherein the substrate is hair and the product a hair dye product.

3. A method according to claim 1 wherein the predetermined set of colors is at least partially displayed on a computer screen when the matching color is selected.

4. A method according to claim 3 wherein the computer screen is an interactive screen.

5. A method according to claim 3 wherein the initial color and the at least partially displayed predetermined set of colors are simultaneously displayed so that the initial color and the at least partially displayed predetermined set of colors can be visually compared at the time of the selection of the matching color.

6. A method according to claim 5 wherein the initial color is displayed by a mirror reflecting the substrate.

7. A method according to claim 1 wherein the predetermined set of colors is ordered in a list according to a visually identifiable parameter and wherein the fraction displayed can be selected by a user.

8. A method according to claim 1 wherein the information relating to the initial color of the substrate is input by physically activating an electro-mechanical device capable of transforming a stimulus selected from a movement or a pressure, into an electronic signal.

9. A method according to claim 8 wherein the information relating to the initial color of the substrate is input by pressing a sensitive area of an interactive screen on which the predetermined set of colors is at least partially displayed.

10. A method according to claim 1 wherein the likely result of the coloration is displayed on a computer screen and is selected from a predetermined set of colors.

11. A method according to claim 1 wherein upon display of the likely result of the coloration, the method further comprises the subsequent steps of:

e. inputting information relating to a desired color different from the result displayed in the predicting system,
f. predicting at least one coloring product capable of providing the desired color to the substrate, and
g. displaying information about the at least one coloring product capable of providing the desired color.

12. A method according to claim 11 wherein the information relating to the desired color is a color selected from a predetermined set of achievable colors.

13. A method according to claim 12 wherein the predetermined set of achievable colors is arranged as a list of achievable colors ordered according to a visually identifiable parameter and wherein only a fraction of said list of colors is displayed at one time and wherein the fraction displayed can be selected by a user.

14. A method according to claim 13 wherein the colors are ordered in the list according to according to a parameter selected from the group consisting of lightness, tonal value and combinations thereof.

15. A method according to claim 11 wherein the predetermined set of achievable colors is displayed on an interactive computer screen.

16. A method according to claim 1 wherein the information relating to the coloring product is scanned from a bar-code figuring on the package of the coloring product and is transmitted to the micro-processing system through a bar-code scanning device.

17. An apparatus for predicting the result of the coloration of a substrate by a coloring product, said apparatus comprising:

a. a micro-processing system,
b. means for inputting information relating to the coloring product in the micro-processing system,
c. means for inputting information relating to the initial color of the substrate in the micro-processing system, wherein the means for inputting information relating to the initial color of the substrate is an electro-mechanical device capable of transforming a stimulus selected from a movement or a pressure into an electronic signal, and wherein the micro-processing system is capable of predicting from the input information a likely result of the coloration of the substrate by the coloring product, and
d. means for displaying the likely result of the coloration as predicted by the micro-processing system.

18. An apparatus according to claim 17 wherein the means for inputting information relating to the coloring product in the predicting system is a bar-code scanning device.

19. An apparatus according to claim 17 wherein the means for inputting information relating to the initial color of the substrate is an interactive screen.

20. An apparatus according to claim 17 wherein the means for displaying the likely result of the coloration is a computer screen.

21. An apparatus according to claim 17 further comprising means for displaying the initial color of the substrate.

22. An apparatus according to claim 21 wherein said means for displaying the initial color of the substrate is a mirror.

23. An apparatus according to claims 17 further comprising:

e. means for inputting information relating to a desired color different from the likely result of the coloration,
f. a micro-processing system programmed for predicting a coloring product capable of achieving the desired color, and
g. means for displaying information relating to a coloring product capable of achieving the desired color.

24. An apparatus according to claim 23 wherein the means for inputting information relating to the desired color is an electro-mechanical device capable of transforming a stimulus selected from a movement or a pressure into an electronic signal.

25. An apparatus according to claim 24 wherein the means for inputting information relating to the desired color is an interactive screen.

26. An apparatus according to claim 23 wherein the means for displaying information relating to the coloring product capable of achieving the desired color is a computer screen and wherein the information displayed is a picture of a packaged product.

* * * * *